US006467934B1

(12) United States Patent
Holten et al.

(10) Patent No.: US 6,467,934 B1
(45) Date of Patent: Oct. 22, 2002

(54) REFLECTOR SYSTEM FOR ELONGATED LIGHT SOURCE

(75) Inventors: Petrus Adrianus Josephus Holten; Nicolas Christian Pichelin, both of Winterswijk (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 31 days.

(21) Appl. No.: 09/711,233

(22) Filed: Nov. 13, 2000

(30) Foreign Application Priority Data

Nov. 12, 1999 (EP) ..... 99203781

(51) Int. Cl.[7] ..... F21V 7/00

(52) U.S. Cl. ..... 362/298; 362/304; 362/346; 362/347; 359/852

(58) Field of Search ..... 362/217, 280, 362/291, 297, 298, 301, 303, 304, 342, 343, 346, 347, 354, 147; 359/852

(56) References Cited

U.S. PATENT DOCUMENTS 2,429,141 A * 10/1947 Taylor ..... 362/217
2,537,398 A * 1/1951 Dameral ..... 362/217
4,194,234 A * 3/1980 Geissler ..... 362/17
4,539,628 A * 9/1985 Bartenbach ..... 362/217
4,717,992 A * 1/1988 Bartenbach et al. ..... 362/217
5,448,462 A * 9/1995 Moran, III ..... 362/297
5,528,478 A * 6/1996 Degelmann ..... 362/290
5,758,954 A * 6/1998 Holten et al. ..... 362/147
5,944,411 A * 8/1999 Holten et al. ..... 362/290

FOREIGN PATENT DOCUMENTS

EP 0619006 B1 10/1994 ..... F21V/7/12

* cited by examiner

*Primary Examiner*—Sandra O'Shea
*Assistant Examiner*—Ismael Negron
(74) *Attorney, Agent, or Firm*—Frank Keegan

(57) ABSTRACT

A luminaire has two oppositely positioned rows with reflectors made of separate sectors. The individual reflectors are separated by edge portions, which are positioned transversely to the longitudinal axis of the luminaire and transversely to a light emission window. The edge portions are spaced apart by a distance D, measured transversely to the longitudinal axis, of between 1 and 2 times the diameter of an associated lamp.

23 Claims, 3 Drawing Sheets

REFLECTOR SYSTEM FOR ELONGATED LIGHT SOURCE

FIELD OF THE INVENTION

The invention relates to a luminaire comprising:

concave reflectors arranged on either side of a longitudinal axis and around said longitudinal axis and each having an edge which defines a light emission window;

edge portions at least partly transverse to the longitudinal axis and transverse to the light emission window; and connection means for accommodating a lamp to be operated, which lamp has a diameter $\phi_{lamp}$.

BACKGROUND OF THE INVENTION

Such a luminaire is known, for example, from U.S. Pat. No. 5,758,954. The known luminaire is built up from a plurality of reflectors, and the edge portions arranged transversely to the longitudinal axis are constructed as lamellae which extend between mutually opposed edges, such that the light emission window is subdivided into (separate) compartments.

The reflectors concentrate the light generated by an accommodated lamp into a beam, but they also provide a screening. The result of this is that the lamp cannot be observed from a direction perpendicular to the longitudinal axis, in so-called C0 planes, at an angle to a plane Q lying parallel to the light emission window which is smaller than a chosen cut-off angle β. The cut-off angle β is usually 30° when the position of plane Q is horizontal in the illumination of spaces in which picture screens are positioned so as to avoid a reflection of the lamp on said screens. It is the function of the lamellae to achieve that the lamp cannot be observed at angles smaller than the cut-off angle β of 30° also from directions in the extension of the longitudinal axis, referred to as C90 planes in illumination engineering. They intercept light emitted at smaller angles and reflect, deflect, and/or scatter it. The reflectors and the lamellae have an identical function in the C planes between C0 and C90. Since there is no material which reflects incident light for 100%, but absorption always partly occurs, lamellae cause not only a screening, and thus comfort for the user of the space illuminated by the luminaire, but also a loss of light.

A disadvantage of the known luminaire is that the lamellae make the luminaire comparatively expensive. The luminaire is to be partly disassembled for the insertion or removal of a lamp, which renders the replacement of a lamp provided in the luminaire comparatively difficult. The fact that the luminaire has to be partly dismountable requires a construction of the luminaire which has the disadvantage that the assembly of the luminaire is comparatively difficult.

A luminaire is known from EP-B-0 619 006, which luminaire is built up from a plurality of reflectors. Two mutually opposed reflectors together with two edge portions, i.e. lamellae, together form a closed octagonal contour. A disadvantage of the known luminaire is that the lamellae render the luminaire comparatively expensive. It is furthermore a disadvantage that assembling of the luminaire is comparatively cumbersome, and that a lamp provided in the luminaire is difficult to replace. A further disadvantage is the loss of light caused by the lamellae.

SUMMARY OF THE INVENTION

It is an object of the invention to provide a luminaire of the kind described in the opening paragraph in which the above disadvantages are counteracted while substantially the same beam-shaping quality of light is retained.

According to the invention, this object is achieved in that a luminaire of the kind described in the opening paragraph is characterized in that the edge portions facing the longitudinal axis and arranged in mutual opposition are separated by an interspacing D measured transversely to the longitudinal axis for the purpose of inserting the lamp to be operated in the luminaire.

The above measure achieves that the luminaire can be free from lamellae, while it was found that the screening against visibility of the lamp in the planes C0–C75, for angles smaller than a cut-off angle β of 30° to a plane Q parallel to the light emission window, and the beam-shaping qualities are substantially the same as with the known luminaire. The interspacing D is greater than $\phi_{lamp}$ for the purpose of easy mounting of the relevant lamp with diameter $\phi_{lamp}$ in the luminaire or its removal from the luminaire without the necessity of dismantling the luminaire, for example in that the edge portions are to be removed. A further advantage is that the light output of the luminaire is increased because the luminaire is free from edge portions over a distance D of at least $\phi_{lamp}$, so that light losses owing to absorption of light by the edge portions can occur to a lesser degree. A further advantage is the low cost price of the luminaire because less material is required for the luminaire. Another advantage is that the luminaire need no longer be partly dismountable, which leads to a simplified assembly of the luminaire.

The known lamp has the further disadvantage that it may cause a glare effect which is perceived as unpleasant by an observer because a continuous reflected image of the lamp occurs in the reflector parallel to the longitudinal axis and resembling the lamp. To counteract this effect, an embodiment of the luminaire is characterized in that each reflector is concavely curved about an axis which is transverse to the light emission window. When observed from observation directions in which the angle is greater than the cut-off angle β of 30°, accordingly, the luminaire causes substantially no glare to an observer with the reflected image of the lamp.

In a favorable embodiment, the luminaire is characterized in that it is provided with screening means for screening an observer from directly emitted light originating from a lamp arranged in the luminaire. Thanks to this measure, the light beam and the lumen output remain at least substantially the same as in the known luminaire, but direct glare at angles smaller than the cut-off angle β, which is also partly determined by the choice of the screening means, does not occur in planes C0–C90. The screening means may comprise, for example, a window reflector which is arranged parallel to the longitudinal axis and is situated substantially between the connection means and the light emission window. The window reflector may have a shape which is somewhat curved around the lamp so as to make this reflector rigid. A lamp provided in the luminaire can be exchanged comparatively easily because only one window reflector is to be removed from the luminaire according to the invention instead of a plurality of lamellae which are to be removed for this purpose in the known luminaire.

In an alternative embodiment in which the luminaire is provided with a lamp, the luminaire is characterized in that the screening means comprise a coating on a side of the lamp which faces towards the light emission window. The coating may be provided internally and/or externally on a portion of the circumference of the lamp and may be chosen such that the light is partly transmitted and partly reflected. If the coating is provided on the side of the lamp facing towards the light emission window over the circumference of the lamp so as to cover 140° thereof, no glare will be visible at angles smaller than the cut-off angle β of 60° in the planes C0–C90. The degree of light transmission of the coating can be easily adjusted through the choice of the material and/or the layer thickness of the coating. It is thus possible in a simple manner to control the brightness of the side of the lamp which faces towards the light emission window.

In an alternative embodiment, the luminaire is characterized in that the interspacing D has a value of at most $2*\phi_{lamp}$. If the interspacing D is smaller than $2*\phi_{lamp}$, the risk of glare remains comparatively small upon observation from planes other than C0 because the cut-off angle β remains at least 30 in these planes. The risk of glare may also be kept comparatively small upon observation from the planes C75–C90 in combination with the screening means.

In a favorable embodiment, the luminaire is characterized in that the interspacing D decreases in size in a direction from the light emission window to the connection means, said decrease in size having a decrease direction which encloses an angle of at least 65° with the light emission window, preferably at least 75°. A lamp accommodated in the luminaire can be exchanged even more easily as a result of this.

In a further embodiment, the luminaire is characterized in that each reflector comprises at least two sectors which are each concavely curved around an axis which is individual to the respective sector and which is at least substantially transverse to the light emission window. The sectors of the luminaire each have a reflecting surface. The sectors are preferably characterized by cross-sections of respective C0 and C90 planes through the reflecting surface which define at least substantially the same concave curve, the respective tangent line thereto in the light emission window enclosing an angle y with the light emission window, in the plane C0 an angle $\gamma_1$ and in the plane C90 an angle $\gamma_2$, such that $90° \geqq \gamma_1 \geqq \gamma_2$, while $\gamma_1 \geqq \gamma \geqq \gamma_2$ upon a traversal of the planes C0–C90, with y decreasing from $\gamma_1$ to $\gamma_2$. A C0 plane here extends through a point of the reflector surface farthest removed from the longitudinal axis, and the edge portions have ends through which a C90 plane extends. The concave curve may be defined, for example, by a parabola or a (bi-)spline function because a beam focusing of the light can be achieved comparatively easily thereby. Each reflector is built up from several sectors which may adjoin one another at an angle. This has the advantage that the reflectors may be comparatively narrow in the direction of the longitudinal axis and can be comparatively deep in a direction transverse to the longitudinal axis. The edge portions thus have a screening effect in the planes C0–C75 which is at least substantially the same as that of lamellae in the known luminaire.

In yet another embodiment, the luminaire is characterized in that the luminaire is built up from a plurality of reflectors. These reflectors may be used as separate modules, so that a flexible arrangement of the luminaire is achievable. The choice of the number and shape of the modules thus renders it possible in a simple manner to adapt the length of the luminaire to the length and shape of the lamp.

In another embodiment in which the respective light emission windows lie in one plane, the luminaire is characterized in that the plurality of reflectors are arranged in a circular shape, while the plurality of the light emission windows of the respective reflectors form one light emission window. A luminaire obtained in this manner is suitable for accommodating a circular low-pressure gas discharge lamp. It is alternatively possible through the simultaneous use of different types of reflectors in the luminaire to vary the optical properties, for example the beam focusing and the degree of diffuse reflection, of the luminaire along its longitudinal axis and to adapt them to the wishes of a customer.

The luminaire according to the invention may be designed, for example, for accommodating a straight tubular electric lamp, for example a fluorescent lamp such as a low-pressure mercury vapor discharge lamp. The luminaire may alternatively be designed for an elongate lamp which comprises, for example, two straight interconnected tubular portions next to one another. The luminaire may or may not have a housing in which the reflector is accommodated. The two mutually opposed reflectors may together form one integral part. The manufacture of the reflector may be achieved, for example, by means of deformation of, for example, metal plating, or, for example, by injection molding of, for example, synthetic resin. To obtain a suitable reflector surface quality, the reflector may be coated, for example metallized with, for example, aluminum, or, for example, may be painted with, for example, titanium oxide.

BRIEF DESCRIPTION OF THE DRAWINGS

Embodiments of the luminaire according to the invention are shown in the drawing, in which.

DETAILED DESCRIPTION OF THE PREFERRED EMBODIMENTS

Figure 1:
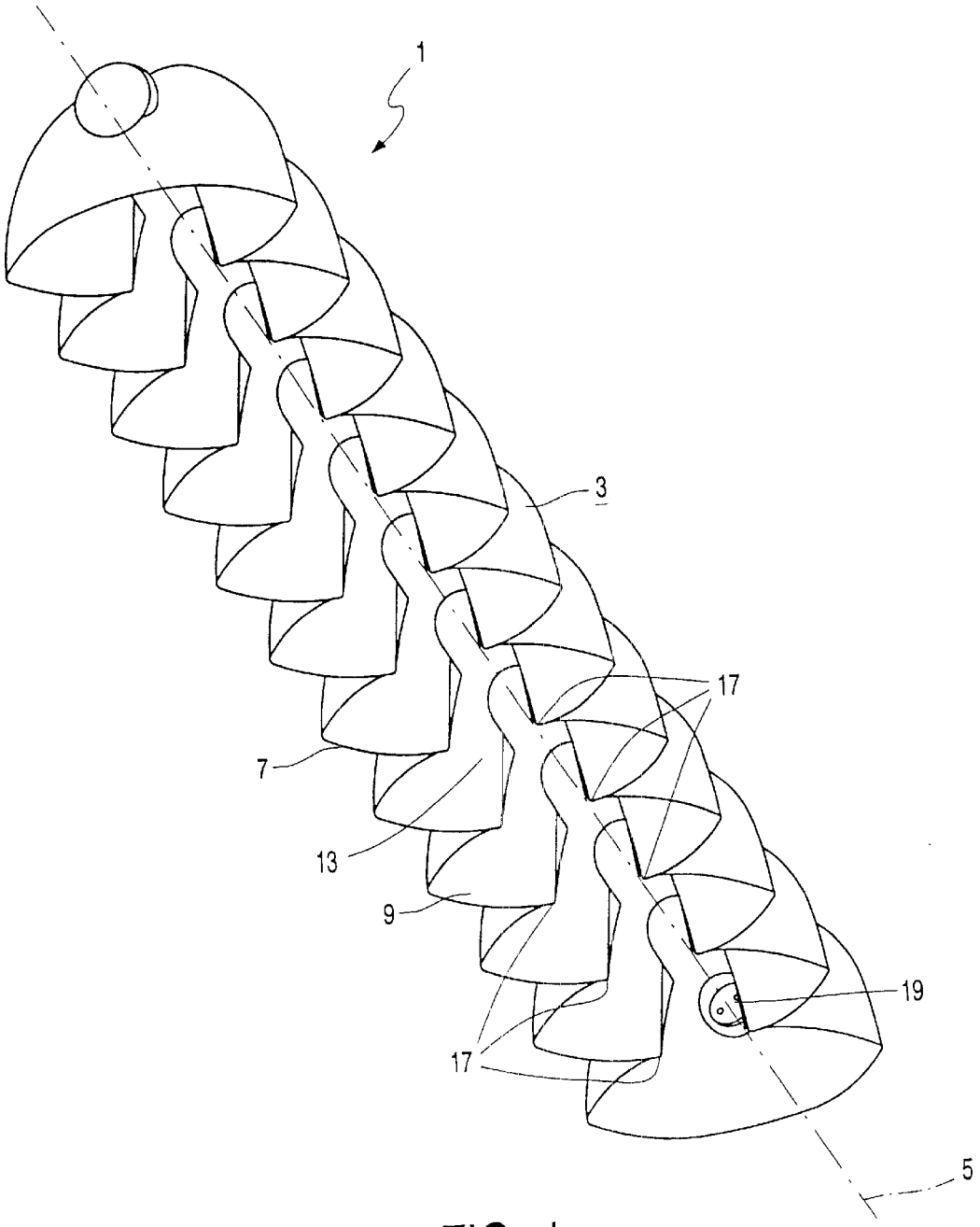
FIG. 1 shows part of a luminaire in perspective view, viewed from a C60 plane at an angle of 75°.

The luminaire 1 of FIG. 1 comprises reflectors 3 which define a longitudinal axis 5 and which bound a light emission window 9 by their edges 7. The reflectors 3 are concavely curved around the longitudinal axis 5. The luminaire 1 forms one integral whole of two transversely mutually opposed units which each comprise a plurality of reflectors 3 which are situated next to one another in the direction of the longitudinal axis 5. Reflectors 3 situated next to one another have their boundaries at edge portions 17 which are transverse to the light emission window 9 and at least partly transverse to the longitudinal axis 5. The luminaire 1 is further provided with connection means 19 for accommodating an electric lamp (lamp not shown in FIG. 1, see FIG. 3A) with a diameter $\phi_{lamp}$ of, for example, 16 mm. Each pair of edge portions 17 situated transversely opposite one another has its edge portions separated from one another by an interspacing D of, for example, 20 mm ($=1.25*\phi_{lamp}$), measured in a direction transverse to the longitudinal axis 5. A lamp, such as a tubular lamp 21 for example (not shown in FIG. 1) suitable for the luminaire 1 is displaceable with clearance between the transversely mutually opposed edge portions 17.

Figure 2:
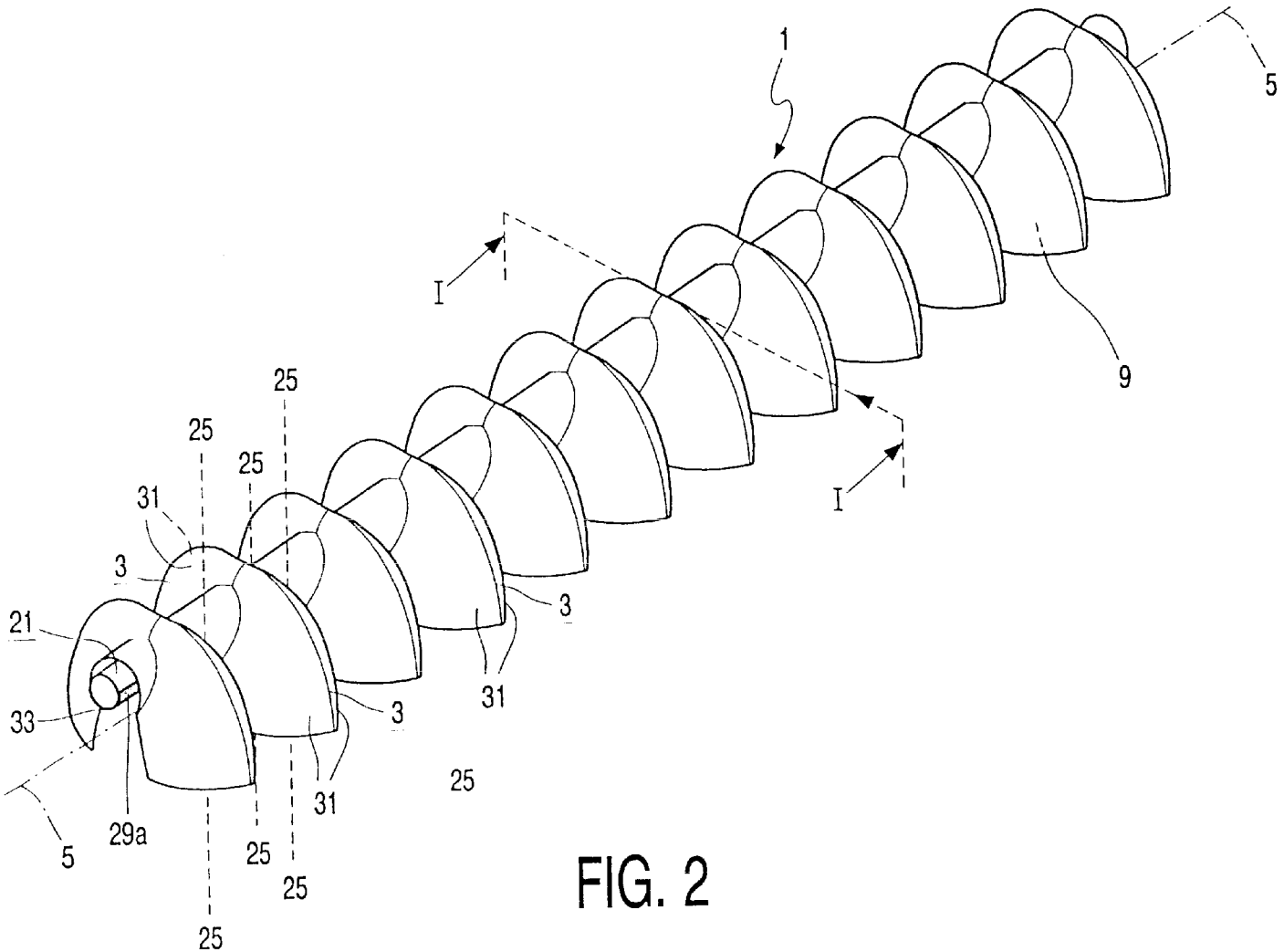
FIG. 2 shows part of the luminaire of FIG. 1 viewed in an oblique plane in the direction of light issuing from the light emission window and originating from the lamp.

FIG. 2 shows the same luminaire 1 in perspective view, viewed from a direction away from the light emission window 9, which luminaire 1 is provided with a tubular lamp 21. The luminaire 1 has a characteristic caterpillar appearance. The tubular lamp 21 is provided with a partly light-transmitting coating 29*a*, which is present on a side 33 of the tubular lamp 21 which faces towards the light emission window 9. The reflectors 3 are subdivided into sectors 31. Each sector 31 is concavely curved around an individual axis 25 of the respective sector 31.

Figure 3A:
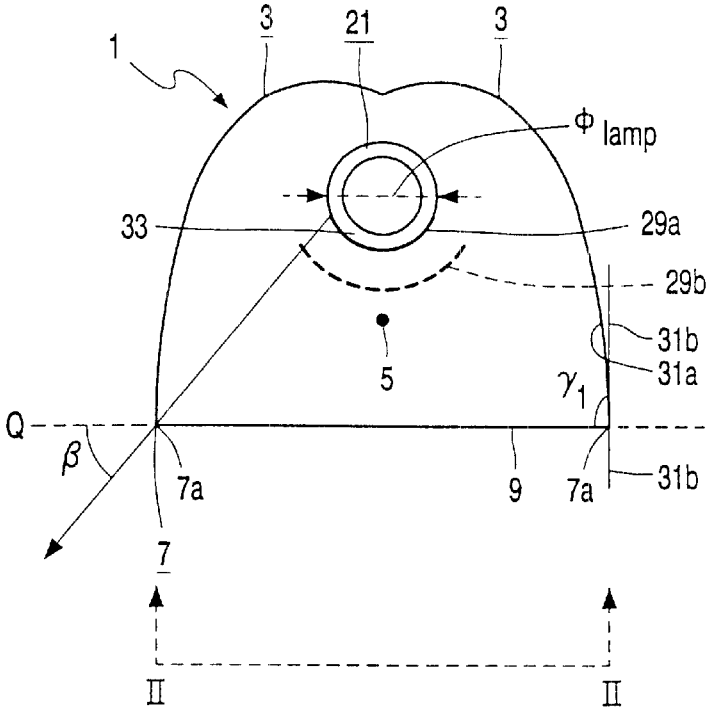
FIG. 3A is a cross-sectional view of the luminaire of FIG. 2 taken on the line I—I.

FIG. 3A shows the cross-sectional plane of the cross-section I—I through the luminaire 1 in the embodiment of FIG. 2. The tubular lamp 21, with a diameter $\phi_{lamp}$ of 16 mm, is held in the connection means 19 (not shown in FIG. 2). The tubular lamp 21 is provided with the coating 29*a* which is present on the side 33 of the tubular lamp 21 facing towards the light emission window 9 so as to cover an angle of 140°. Alternatively, the coating 29*a* may be replaced by a window reflector 29*b* (shown in a broken line) for serving as the screening means, which reflector is placed between the reflectors 3, and between the tubular lamp 21 and the light emission window 9, and which reflector is curved somewhat around the tubular lamp 21. In FIG. 3A, the edge 7 of the reflectors 3 together with the coating 29*a* defines a greatest screening angle β with plane Q, at which angle the tubular lamp 21 can no longer be observed in the C0 plane shown of the luminaire 1 pictured in cross-section. In FIG. 3A, the screening angle β is 60°. The cross-section of the C0 plane through the reflecting surface 31*a* substantially describes a parabola whose tangent line 31*b* in the light emission window 9 encloses an angle $\gamma_1$ with the light emission window 9.

Figure 3B:
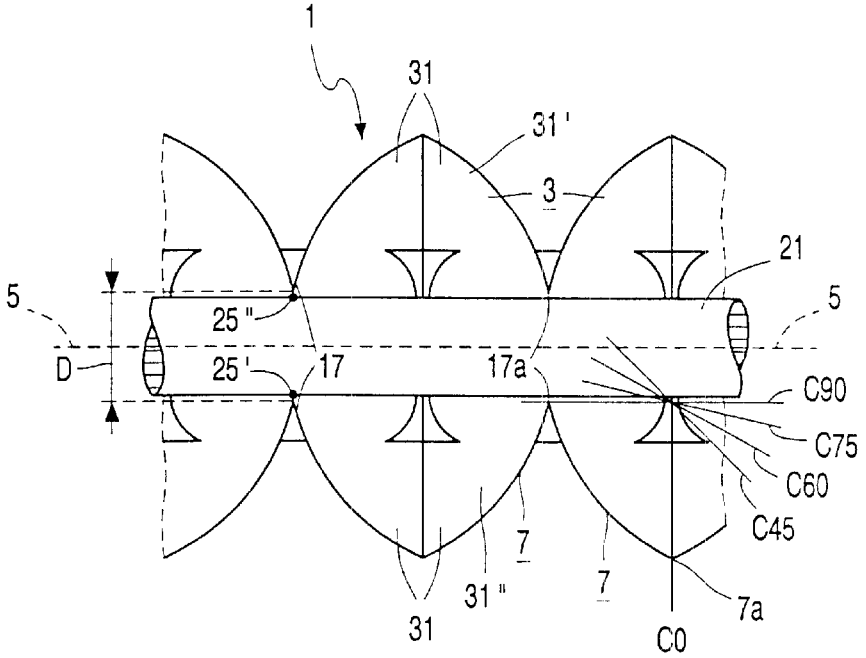
FIG. 3B is an elevation of a portion of the luminaire of FIG. 3A viewed along II.

FIG. 3B shows C0, C45, C60, and C75 planes with respect to the luminaire 1. It is apparent from FIG. 3B that the entire edge 7, but especially the edge portions 17 of the reflectors 3 are of importance for screening an observer against light directly originating from the tubular lamp 21 and issuing from the luminaire 1. The edge portions 17 which face the longitudinal axis 5 and are situated opposite one another are separated by a distance D measured transversely to the longitudinal axis 5. D is 20 mm in FIG. 3B. The reflectors 3 are subdivided into sectors 31. Each sector 31 is concavely curved around an axis 25, which is individual to that sector 31, as is shown in FIG. 3B for two sectors 31' and 31" which are curved around respective axes 25' and 25".

What is claimed is:

1. A luminaire comprising:

concave reflectors arranged on either side of a longitudinal axis of the luminaire and around said longitudinal axis and each having an edge and edge portions, wherein said edge defines a light emission window;

said edge portions being at least partly transverse to the longitudinal axis and transverse to the light emission window; and connection means for accommodating a lamp to be operated, said lamp having a diameter $\phi_{lamp}$, wherein the edge portions facing the longitudinal axis and arranged in mutual opposition are separated by an interspacing D measured transversely to the longitudinal axis for allowing insertion of the lamp.

2. A luminaire as claimed in claim 1, wherein each of said concave reflectors is concavely curved about an individual axis of a respective sector of said each reflector, said individual axis of a respective sector being transverse to the light emission window.

3. A luminaire as claimed in claim 1, wherein each of said concave reflectors comprises at least two sectors which are each concavely curved around an axis which is individual to the respective sector and which is at least substantially transverse to the light emission window.

4. A luminaire as claimed in claim 3, wherein one of the at least two sectors has a reflecting surface, while the edge portions have respective ends, and a plane C0 extends through a point of the reflector surface farthest removed from the longitudinal axis, and a plane C90 extends through the respective end of the edge portion of said one of the at least two sectors, wherein cross-sections of said plane C0 and plane C90 and of planes at angles intermediate to said plane C0 and plane C90, through the reflecting surface, define concave curves which have, at least substantially, the same shape, respective tangent lines from the intersection of said curves with the light emission window enclosing angles γ with the light emission window, and said angles including an angle $\gamma_1$ in plane C0 and an angle $\gamma_2$ in plane C90, such that for each angle γ, $90° \geqq \gamma_1 \geqq \gamma_2$, and $\gamma_1 \geqq \gamma \geqq \gamma_2$ and, upon a traversal of the planes C0–C90, γ decreases in value from $\gamma_1$ to $\gamma_2$.

5. A luminaire as claimed in claim 1, wherein the luminaire is built up from a plurality of said concave reflectors.

6. A luminaire as claimed in claim 5, in which respective light emission windows of said concave reflectors lie in one plane, wherein the plurality of said concave reflectors are arranged in a circular shape and the plurality of the light emission windows of the plurality of the concave reflectors form one light emission window of the luminaire.

7. A luminaire as claimed in claim 1, wherein the luminaire is provided with screening means.

8. A luminaire as claimed in claim 7, wherein said screening means comprise a window reflector which extends parallel to the longitudinal axis and which is situated between the connection means and the light emission window.

9. A luminaire as claimed in claim 7, wherein the screening means comprise a coating on a side of the lamp which faces towards the light emission window.

10. A luminaire as claimed in claim 9, wherein the coating is partly light-transmitting.

11. A luminaire comprising:

concave reflectors arranged on either side of a longitudinal axis of said luminaire and around said longitudinal axis and each having an edge which defines a light emission window;

edge portions at least partly transverse to the longitudinal axis and transverse to the light emission window; and connection means for accommodating a lamp to be operated, which lamp extends along said longitudinal axis has a diameter $\phi_{lamp}$;

wherein the edge portions facing the longitudinal axis and arranged in mutual opposition are separated by an interspacing D measured transversely to the longitudinal axis for the purpose of inserting the lamp to be operated in the luminaire, and wherein the interspacing D has a value of at most $2^*\phi_{lamp}$.

12. A luminaire as claimed in claim 11, wherein the interspacing D decreases in a direction from the light emission window toward said lamp, said luminaire being configured to allow a light ray from said lamp to leave an end of the light emission window at said edge at an angle of at least 65° with the light emission window.

13. A luminaire as claimed in claim 8, wherein said angle is at least 75°.

14. A luminaire comprising:

reflectors arranged along a longitudinal axis of the luminaire, each said reflector having a concave shape, said reflectors being at least arranged in pairs, each member of one of said pairs being opposite and opening toward the other member, the members of each said pair being joined together along a line parallel to the longitudinal axis of the luminaire, each said concave reflector pair being joined to another said reflector pair at one or more points on an axis transverse to said longitudinal axis, each said pair having an edge which defines a light emission window of the luminaire, said light emission window opening in a direction opposite said side of the luminaire, said edges comprising edge portions at least partly transverse to the longitudinal axis and transverse to the light emission window; and the luminaire further comprising connection means for accommodating a lamp to be operated, which lamp has a diameter $\phi_{lamp}$, wherein the edge portions facing the longitudinal axis and arranged in mutual opposition are separated by an interspacing D measured transversely to the longitudinal axis for allowing insertion of the lamp in the luminaire.

15. A luminaire as claimed in claim 14, wherein the luminaire is provided with a window reflector which extends parallel to the longitudinal axis and which is situated between the lamp and the light emission window.

16. A luminaire as claimed in claim 14, wherein the luminaire is provided with a coating on a side of the lamp which faces the light emission window.

17. A luminaire as claimed in claim 14, wherein the interspacing D has a value of at most $2*\phi_{lamp}$.

18. A luminaire as claimed in claim 14, wherein a first cross-section of each said reflector in a first plane transverse to the longitudinal axis and transverse to the light emitting window defines a first concave curve and a second cross-section of each said reflector in a second plane transverse to the first plane and parallel to the light emitting window defines a second concave curve.

19. A luminaire as claimed in claim 18, wherein the first concave curve and the second concave curve are substantially the same shape.

20. A luminaire comprising:

concave reflectors arranged on either side of a longitudinal axis of the luminaire and around said longitudinal axis and each having an edge which defines a light emission window;

edge portions at least partly transverse to the longitudinal axis and transverse to the light emission window; and connection means for accommodating a lamp to be operated, which lamp has a diameter $\phi_{lamp}$, the edge portions facing the longitudinal axis and being arranged in mutual opposition are separated by an interspacing D measured transversely to the longitudinal axis, for the purpose of inserting the lamp to be operated in the luminaire, each said concave reflector comprising at least two sectors, each said sector being concavely curved around a sector axis, said sector axis being at least substantially transverse to the light emission window.

21. A luminaire comprising successive reflectors joined together on opposite sides of and along a longitudinal axis of the luminaire, said luminaire having an enclosed side along the longitudinal axis, a light emission window opposite said enclosed side and two ends comprising connection means, each said reflector having a first concave cross-section in a first plane parallel to the light emission window and a second concave cross-section in a second plane transverse to said first plane, said luminaire further comprising a channel in the successive reflectors, said channel connecting the two ends of the luminaire and being open in the direction of the light emission window for allowing insertion of the lamp in the luminaire, said channel having edge portions separated by a narrowest spacing D, measured from the longitudinal axis.

22. A luminaire as claimed in claim 21, wherein the first concave cross-section and the second concave cross-section are substantially the same shape.

23. A luminaire as claimed in claim 21, wherein the interspacing D has a value of at most $2*\phi_{lamp}$.

* * * * *